US009864303B2

(12) United States Patent
Watanabe

(10) Patent No.: US 9,864,303 B2
(45) Date of Patent: Jan. 9, 2018

(54) DEVELOPER CONTAINER, DEVELOPING DEVICE, PROCESS CARTRIDGE, AND IMAGE FORMING APPARATUS

(71) Applicant: CANON KABUSHIKI KAISHA, Tokyo (JP)

(72) Inventor: Yosuke Watanabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/052,683

(22) Filed: Feb. 24, 2016

(65) Prior Publication Data

US 2016/0252844 A1 Sep. 1, 2016

(30) Foreign Application Priority Data

Feb. 27, 2015 (JP) ..... 2015-039428

(51) Int. Cl.
*G03G 15/08* (2006.01)

(52) U.S. Cl.
CPC ..... *G03G 15/0882* (2013.01); *G03G 15/0841* (2013.01); *G03G 2215/0687* (2013.01)

(58) Field of Classification Search
CPC ..... G03G 15/0881; G03G 15/0882; G03G 15/0886; G03G 15/0889; G03G 15/0841; G03G 15/0874; G03G 2215/0682; G03G 2215/0687; G03G 2215/0819; G03G 2215/085
USPC ..... 399/106, 103, 105
See application file for complete search history.

(56) References Cited

U.S. PATENT DOCUMENTS

2013/0308972 A1* 11/2013 Shindo ..... G03G 15/0882 399/106
2014/0199092 A1* 7/2014 Matsushita ..... G03G 15/0841 399/106
2014/0212166 A1* 7/2014 Takeuchi ..... G03G 15/0882 399/106
2014/0212181 A1* 7/2014 Nakamura ..... G03G 15/0874 399/258
2014/0356020 A1* 12/2014 Murakami ..... G03G 15/0882 399/106
2014/0376955 A1* 12/2014 Takeuchi ..... G03G 15/0881 399/106
2015/0248079 A1* 9/2015 Tokudome ..... G03G 15/0882 399/103
2016/0062270 A1* 3/2016 Fukasawa ..... G03G 15/0882 399/106
2016/0116864 A1* 4/2016 Kase ..... G03G 15/0874 399/109

FOREIGN PATENT DOCUMENTS

JP 2008-129152 A 6/2008
JP 2013-37346 A 2/2013

* cited by examiner

*Primary Examiner* — Sophia S Chen
(74) *Attorney, Agent, or Firm* — Canon USA, Inc. I.P. Division

(57) ABSTRACT

A developer container includes a container configured to store developer and capable of discharging the developer from an opening, a sealing member configured to seal the opening, an unsealing member, rotatably supported, configured to open the opening by removing the sealing member from the container, and a sheet member attached to an attachment portion of the unsealing member in a relative position where the sheet member is held between the sealing member and the unsealing member.

33 Claims, 7 Drawing Sheets

DEVELOPER CONTAINER, DEVELOPING DEVICE, PROCESS CARTRIDGE, AND IMAGE FORMING APPARATUS

BACKGROUND OF THE INVENTION

Field of the Invention

The present invention relates to a developer container, a developing device, a process cartridge, and an image forming apparatus.

The developer container is a container in which developer is accommodated. The developing device includes at least a developing device. The process cartridge includes at least an image bearing member. In many cases, the process cartage includes the image bearing member and a process unit that acts on the image bearing member. The process unit includes a charging unit, an exposure unit, a developing unit, and a cleaning unit. The image forming apparatus is an apparatus for forming an image on a recording medium, and includes a process cartridge detachable from an apparatus main body.

Description of the Related Art

Image forming apparatuses using an electrophotographic image forming system have conventionally employed a process cartridge system in which an electrophotographic photosensitive drum and a process unit acting on the photosensitive drum are integrally provided as a cartridge that is detachable from an apparatus main body.

According to a process cartridge system discussed in each of Japanese Patent Application Laid-Open No. 2013-37346 and Japanese Patent Application Laid-Open No. 2008-129152, a user can perform maintenance work on the apparatus without calling for the assistance of a maintenance service person. This can enhance operability. Consequently, such a process cartridge system has been widely employed in the image forming apparatuses using the electrophotographic systems.

Among such process cartridges, a configuration for sealing and opening a developer supply opening of a flexible container for storing developer has been discussed. According to the configuration, a sealing member is used for sealing the developer supply opening, and a rotary member engaging the sealing member is rotated so that the developer supply opening is opened.

The process cartridge discussed in Japanese Patent Application Laid-Open No. 2013-37346 further includes a sheet-shaped conveyance member engaging the rotary member. This enables the process cartridge to have an additional function of conveying discharged developer to a developing roller and a developer supply roller.

However, an amount of developer inside the flexible container may be increased for increasing the capacity. In such a case, a distance between a sheet member and the flexible container is reduced, and a free end of the sheet member may contact the flexible container. The contact of the sheet member with the flexible container generates noise. Moreover, in a case where a length of the sheet member is increased, the sheet member may collide with an inner wall of the developer container or other components inside the developer container. In such a case, noise is generated in a place other than the flexible container.

SUMMARY OF THE INVENTION

According to an aspect of the present invention, a developer container includes a container configured to store developer and capable of discharging the developer from an opening, a sealing member configured to seal the opening, an unsealing member, rotatably supported, configured to open the opening by removing the sealing member from the container, and a sheet member attached to an attachment portion of the unsealing member in a position where the sheet member is held between the sealing member and the unsealing member.

Moreover, the present invention is directed to a developing device, a process cartridge, and an image forming apparatus.

Further features of the present invention will become apparent from the following description of exemplary embodiments with reference to the attached drawings.

DESCRIPTION OF THE EMBODIMENTS

Hereinafter, exemplary embodiments of the present invention are described with reference to the drawings. However, dimensions, materials, shapes, and relative arrangements of components described in the exemplary embodiments can be selected appropriately according to configurations or various conditions of an apparatus of the exemplary embodiments of the present invention. Hence, description of the exemplary embodiments is not intended to limit the scope of the invention.

Figure 1:
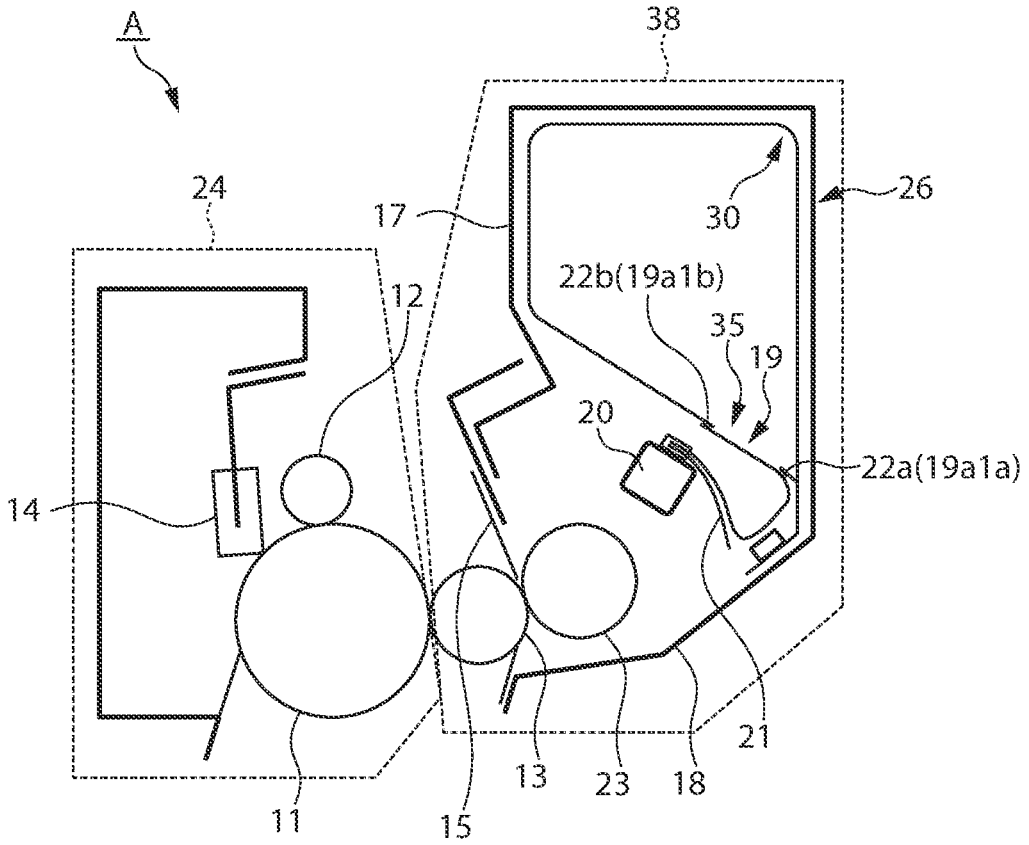
FIG. 1 is a sectional view illustrating a process cartridge according to an exemplary embodiment of the present invention.
Figure 2:
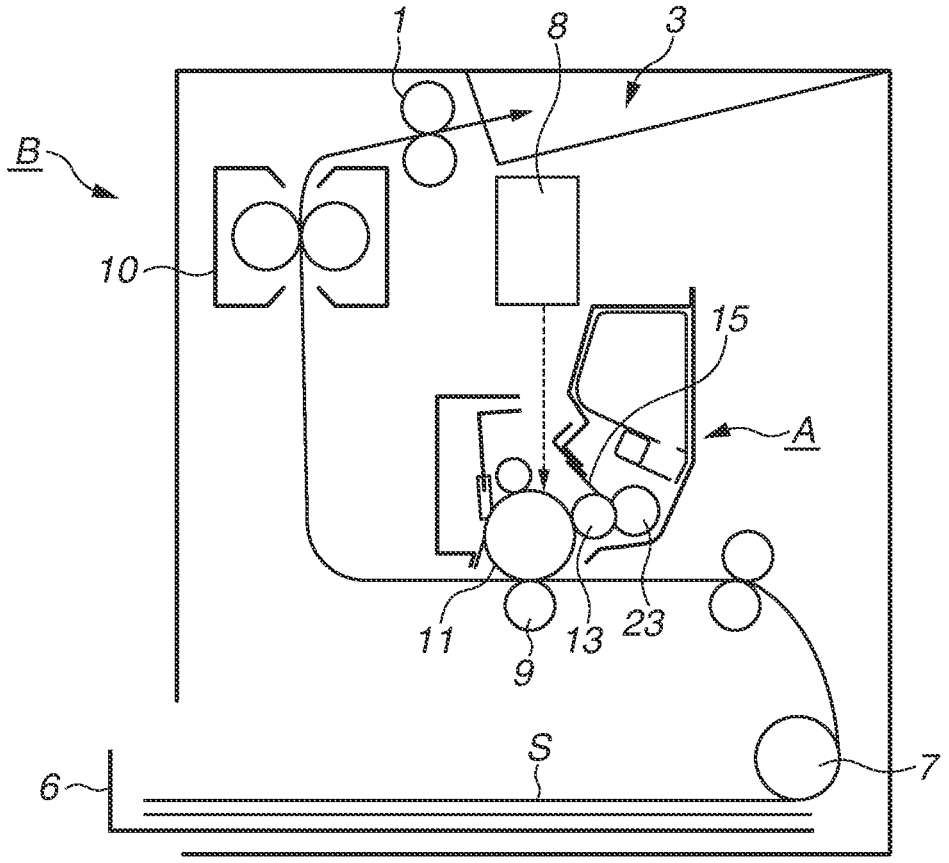
FIG. 2 is a sectional view illustrating an image forming apparatus according to an exemplary embodiment of the present invention.

FIG. 1 is a sectional view of a process cartridge to which an exemplary embodiment of the present invention can be applied, and FIG. 2 is a sectional view of an image forming apparatus to which an exemplary embodiment of the present invention can be applied.

<Configuration of Process Cartridge>

A process cartridge includes an image bearing member and a process unit that acts on the image bearing member. For example, the process unit includes a charging unit for charging a surface of the image bearing member, a developing device for forming an image on the image bearing member, and a cleaning unit for removing a residual developer from the surface of the image bearing member.

A process cartridge A of the present exemplary embodiment, as illustrated in FIG. 1, includes a charging roller 12 serving as a charging unit, and a cleaning unit 24 serving as a cleaning unit that are arranged around a photosensitive drum 11 serving as an image bearing member. The cleaning unit 24 includes a cleaning blade 14. Further, the process cartridge A includes a developing device 38 that includes a first frame 17 and a second frame 18. The developing device 38 includes a developing roller (a developer bearing member) 13 serving as a developing unit. In the present exemplary embodiment, the developing device 38 includes a developing blade 15, a developer supply roller 23, and a developer container 26 in which developer is accommodated. In the first exemplary embodiment, a developer containing container (developer bag) 30 in which the developer is stored is further provided inside the developer container 26. The developing roller 13 and the developing blade 15 are supported by the first frame 17.

<Configuration of Image Forming Apparatus>

The process cartridge A is attached to the image forming apparatus main body B as illustrated in FIG. 2 and thereby is used for image forming. In image forming, a sheet S as a recording medium is conveyed by a conveyance roller 7 from a sheet cassette 6 attached to a lower portion of the image forming apparatus main body B. An exposure device 8 selectively emits light to the photosensitive drum 11 in synchronization with the conveyance of the sheet S, so that a latent image is formed on the photosensitive drum 11. The sponge-like developer supply roller 23 supplies developer to the developing roller 13, and the developing blade 15 causes a surface of the developing roller 13 to bear a thin layer of the developer. A development bias is applied to the developing roller 13, so that the developer is supplied according to the latent image and a developer image is formed. This image is transferred to the sheet S by application of a bias voltage to a transfer roller 9. The sheet S is then conveyed to a fixing apparatus 10 in which the image is fixed. The sheet S with the fixed image is discharged by a discharge roller 1 to a sheet discharge unit 3 arranged on an upper portion of the image forming apparatus main body B.

<Overview of Developer Containing Container>

Figure 3:
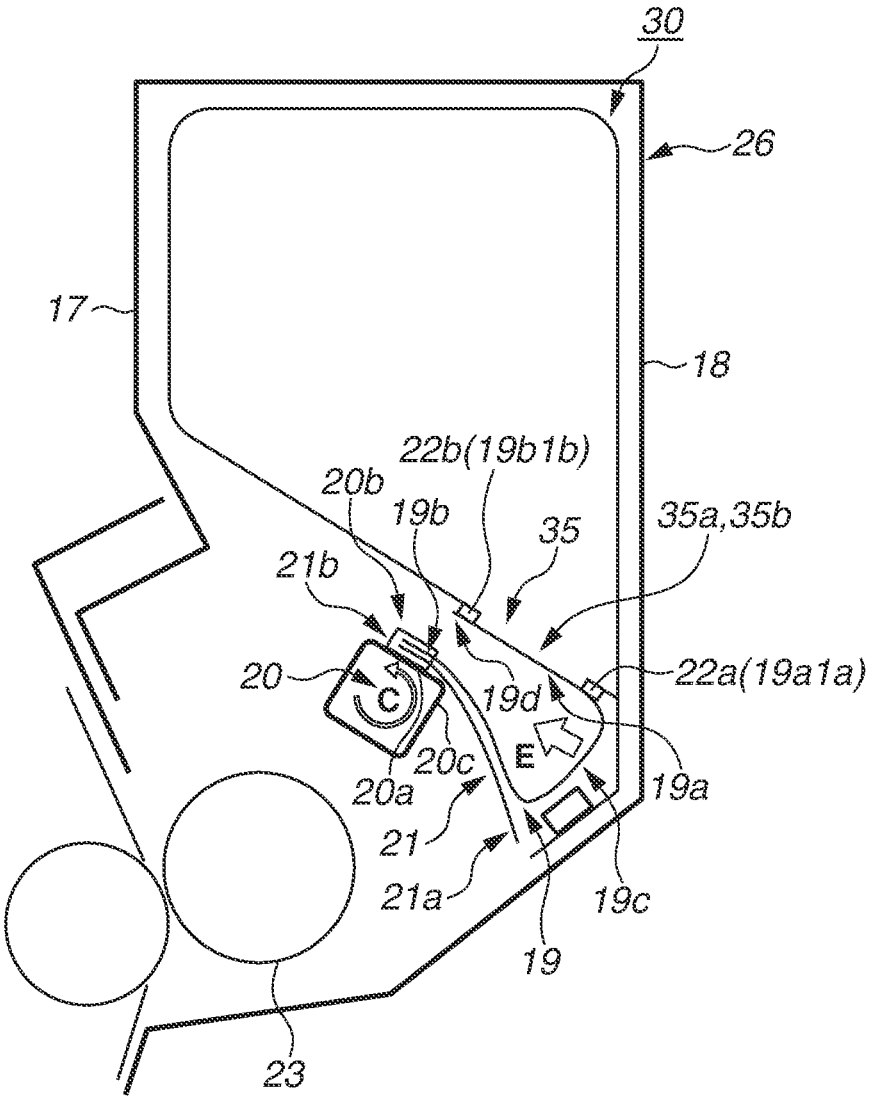
FIG. 3 is a sectional view illustrating a developer accommodation unit before opening according to an exemplary embodiment of the present exemplary embodiment.

As illustrated in FIG. 3, the developer containing container 30 is formed of a flexible container. The developer containing container 30 includes an opening 35*a* from which developer can be discharged. In the first exemplary embodiment, the opening 35*a* is arranged on the lower side of the developer containing container 30 in the direction of gravity. In a state where the opening 35*a* is open, the developer inside the developer containing container 30 falls by gravity and is discharged from the opening 35*a*. The developer containing container 30 may be pressed by a pressing member so that discharge of the developer may be facilitated.

<Configuration of Sheet Member>

As illustrated in FIGS. 3, 4, and 5A through 5F, a sheet member 21 is attached to a rotary member. The sheet member 21 includes an engaged portion 21*b* as a fixed end and a free end portion 21*a* as a free end. The sheet member 21 has a leaf spring constant that is greater than a leaf spring constant in a portion, of a sealing member 19, that contacts the free end portion 21*a* of the sheet member 21 when an unsealing member 20 is rotated. Such a configuration of leaf spring constant is provided in order that the sheet member 21 has a function of conveying developer. Accordingly, a material having a tensile elastic modulus higher than a tensile elastic modulus of a material of the sealing member 19 is used for the sheet member 21. Alternatively, the same material is used for the sheet member 21 and the sealing member 19. In such a case, the sheet member 21 is thicker than the sealing member 19. In the present exemplary embodiment, a length of the sealing member 19 is set in such a manner that the free end portion 21*a* of the sheet member 21 is covered with the sealing member 19 with respect to a rotation direction of the unsealing member 20 when the unsealing member 20 is rotated.

<Configuration of Sealing Member>

As illustrated in FIGS. 3 and 5A through 5F, before using of the process cartridge A, the sealing member 19 covers a discharge portion 35 of the developer containing container 30 in such a manner that the developer inside the developer containing container 30 is not discharged. The sealing member 19 is moved so that the opening 35*a* of the discharge portion 35 is exposed. The sealing member 19 in a sheet shape includes a sealing portion 19*a*, an engaged portion 19*b*, and a sealing member connection portion 19*c*. The sealing portion 19*a* covers the discharge portion 35 of the developer containing container 30. The engaged portion 19*b* is fixed to the unsealing member 20 described below. The sealing member connection portion 19*c* connects the sealing portion 19*a* with the engaged portion 19*b*. For the sealing member 19, a laminate material having a sealant layer that provides easy-to-open property can be appropriately selected for a sheet, and a material, for example, polyethylene terephthalate (PET), polyethylene, polypropylene, or the like, having a thickness of between 0.03 mm and 0.50 mm can be appropriately selected for a base.

(Sealing Portion of Sealing Member)

Figure 4:
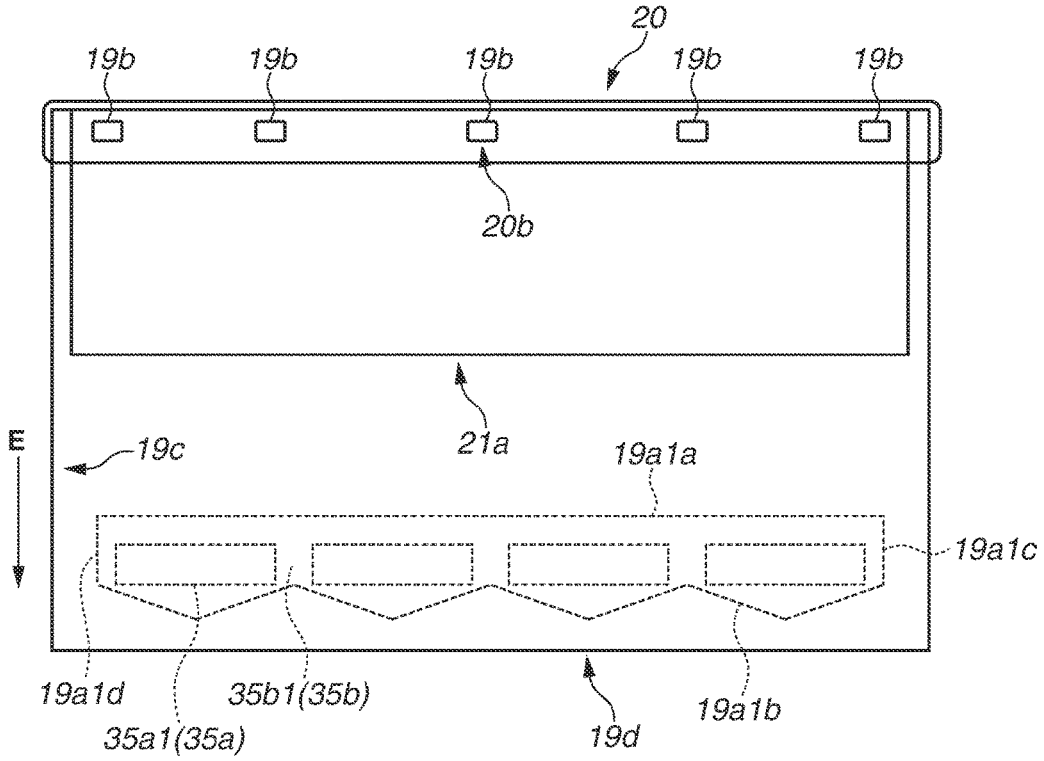
FIG. 4 is a diagram illustrating a rotary member according to an exemplary embodiment of the present invention.

In the present exemplary embodiment, the sealing portion 19*a* indicates an area in which a plurality of openings 35*a* and connection portions 35*b* of the developer containing container 30 are sealed (see FIG. 4). The sealing portion 19*a* prevents leakage of developer from the developer containing container 30 until the process cartridge A is used. When the process cartridge A is used, the sealing portion 19*a* is removed from the developer containing container 30 and the opening 35*a* is opened. A dotted line portion and inside thereof illustrated in FIG. 4 correspond to the sealing portion 19*a*. The sealing portion 19*a* includes an opening corresponding portion 35*a*1 that corresponds to the plurality of openings 35*a* of the developer containing container 30, and a connection corresponding portion 35*b*1 that corresponds to the connection portion 35*b* of the developer containing container 30. In the present exemplary embodiment, the developer containing container 30 and the dotted line portion other than the opening corresponding portion 35*a*1 are bonded by welding (see FIG. 4). Since the welding is used, a portion of the developer containing container 30 and a portion of the sealing member 19 have been melted, thereby forming bonded portions 22*a* and 22*b*. However, hooking or pinching may be used instead of the welding as long as the plurality of openings 35*a* can be sealed. In the present exemplary embodiment, each of the developer containing container 30 and the sealing member 19 includes a bonded portion. The dotted line portion illustrated in FIG. 4 corresponds to a bonded portion 19*a*1 of the sealing portion 19*a*. As illustrated in FIG. 4, the bonded portion 19*a*1 includes a first bonded portion 19*a*1*a* and a second bonded portion 19*a*1*b* extending in a longitudinal direction of the developing device 38 or the plurality of openings 35*a*. Moreover, the bonded portion 19*a*1 includes a third bonded portion 19*a*1*c* and a fourth bonded 19*a*1*d* extending in a lateral direction of the developing device 38 or the plurality of openings 35*a*.

(Engaging Portion of Sealing Member)

The sealing member 19 includes a free end portion on one end side in an opening direction E. In the free end portion, the engaged portion 19*b* which is engaged with the unsealing member 20 for moving the sealing member 19 is arranged. The engaged portion 19*b* is engaged with the unsealing member 20 in order that the sealing member 19 is moved and the plurality of openings 35*a* is exposed. The unsealing member 20 may be automatically opened using driving force received from the image forming apparatus main body B. Alternatively, a user may hold and move the unsealing member 20 to open the opening. In the present exemplary embodiment, the unsealing member 20 is a rotation shaft disposed to a frame, and the sealing member 19 engaged with the unsealing member 20 is pulled and the sealing portion 19*a* is peeled off from the developer containing container 30, whereby the plurality of openings 35*a* of the developer containing container 30 is opened.

<Configuration of Agitation Member>

As illustrated in FIGS. 3 and 5A through 5F, the sheet member 21 according to the present exemplary embodiment has an agitation function. Hereinafter, the sheet member 21 is also referred to as an agitation member 21. The agitation member 21 in a sheet shape includes the engaged portion 21*b*, which is fixed to the unsealing member 20, and the free end portion 21*a*. The agitation member 21 is fixed so as to be held (stacked) between the unsealing member 20 and the sealing member 19. Further, the unsealing member 20 includes a plurality of surfaces (20*a* and 20*c*). The unsealing member 20 is attached on the same surface 20*a* in such a manner that the unsealing member 20 overlaps the sealing member 19. In the present exemplary embodiment, the surface 20*a* serves as an attachment portion. However, the attachment portion is not limited to a surface. The attachment portion may be a linear portion or a point portion.

The sealing member 19 is positioned on a downstream side with respect to a rotation direction of the unsealing member 20, whereas the sheet member 21 is positioned on an upstream side with respect to the rotation direction of the unsealing member 20. The free end portion 21*a* of the agitation member 21 projects outward from a circumscribed circle of the unsealing member 20. A length of the agitation member 21 (a length from the engaged portion 21*b* to the free end portion 21*a*) is shorter than a length of the sealing member 19 (a length from the engaged portion 19*b* to an end portion 19*d*). The free end portion 21*a* of the agitation member 21 is therefore covered with the sealing member 19. Such a configuration provides an effect of reduction in noise generated during a developer agitation operation that will be described below. Further, as illustrated in FIG. 4, in the present exemplary embodiment, a width of the free end portion 21*a* of the agitation member 21 (a length of the free end portion 21*a* in a rotation axis direction of the unsealing member 20) is shorter than a width of the sealing member 19 (a length of the sealing member connection portion 19*c* in the rotation axis direction of the unsealing member 20). Such a configuration further provides a noise-reduction-effect. In the present exemplary embodiment, the sealing member (a developer sealing member) 19 and the agitation member (the sheet member) 21 are fixed on the same surface of the unsealing member 20, but the configuration is not limited thereto. As long as the sealing member 19 covers the free end portion 21*a* of the agitation member 21, the sealing member 19 and the agitation member 21 may be fixed to different surfaces of the unsealing member 20. For the agitation member 21, a flexible sheet, made of a material, for example, PET, polyphenylenesulfide (PPS), polycarbonate, or the like, having a thickness of approximately 0.05 mm to 0.50 mm can be appropriately selected.

<Configuration of Unsealing Member>

The unsealing member 20 is provided to apply force to the sealing member 19 to move the sealing member 19, thereby removing the sealing member 19 from the developer containing container 30. The unsealing member 20 includes a shaft-shaped support portion (not illustrated) and an engaging portion 20*b*. Both ends of the support portion are rotatably supported by the second frame 18, and the engaging portion 20*b* fixes the engaged portion 19*b* of the sealing member 19 and the engaged portion 21*b* of the agitation member 21. In the present exemplary embodiment, the unsealing member 20 is formed in a rectangular shaft shape, and the engaging portion 20*b* engages the engaged portion 19*b* of the sealing member 19 and the engaged portion 21*b* of the agitation member 21 on a surface of the rectangular shaft.

<Opening Operation of Sealing Member>

A drive unit disposed in the image forming apparatus main body B transmits driving force to the process cartridge A via a gear, and the unsealing member 20 is rotated in a direction indicated by an arrow C illustrated in FIG. 3. With the rotation of the unsealing member 20, the sealing member 19 is pulled, so that the first bonded portion 22*a* and the second bonded portion 22*b* are separated from the sealing member 19 in this order. Then, the opening is completed. The developer inside the developer containing container 30 passes through the opening 35*a* of the discharge portion 35 and is discharged.

<Developer Agitation Operation>

Even after completion of the opening of the sealing member 19, the rotation of the unsealing member 20 continues using the driving force transmitted from the drive unit disposed in the image forming apparatus main body B. The agitation member 21 engaging the unsealing member 20 is rotated in response to the rotation of the unsealing member 20. This agitates the developer near the opening 35*a* and the developer supply roller 23, and the developer is thoroughly supplied toward a rotation axis direction of the developing roller 13 and the developer supply roller 23.

In comparative examples as illustrated in FIGS. 6A through 6F, the free end portion 21*a* is not covered with the sealing member 19 during rotation of the agitation member 21. Consequently, a collision of the agitation member 21 may generate large noise.

Figure 6A:
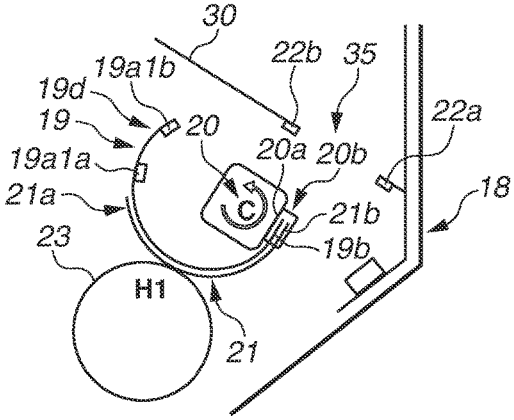
FIGS. 6A, 6B, 6C, 6D, 6E, and 6F are diagrams each illustrating a comparative example.
Figure 6B:
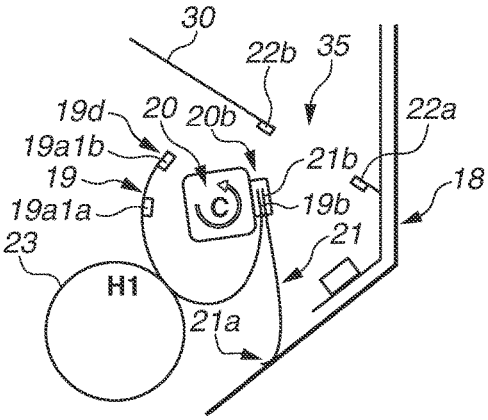
Figure 6C:
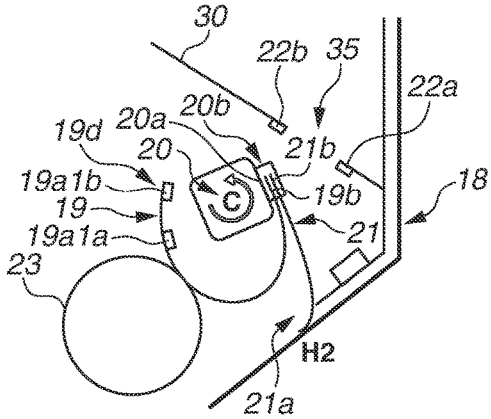
Figure 6D:
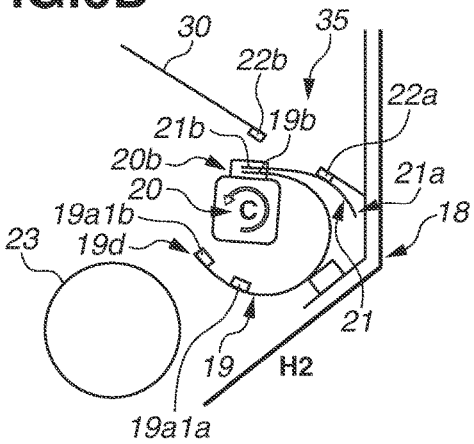
Figure 6E:
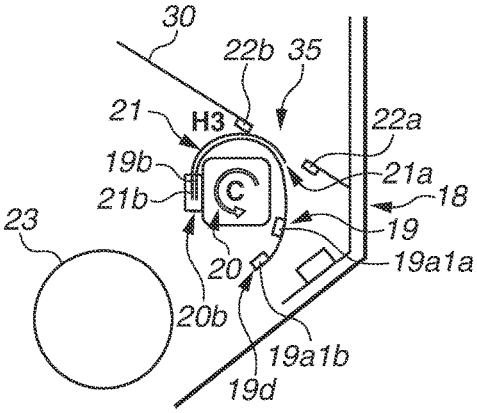
Figure 6F:
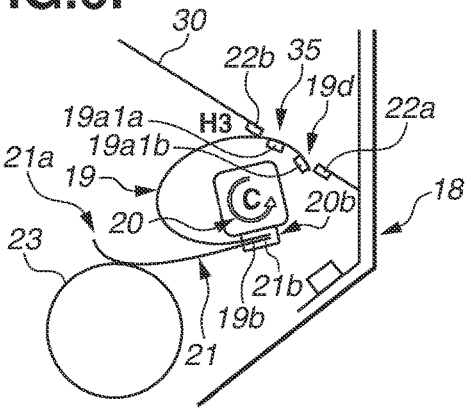

In the rotation of the agitation member 21, if the agitation member 21 contacts a point H1 (FIG. 6A), the rotation of the agitation member 21 is temporarily disturbed. In such a case, the agitation member 21 is elastically deformed toward a direction opposite the rotation direction, and elastic energy is stored. If the agitation member 21 continues to rotate more, pressure of the elastic deformation is released. This changes the elastic energy into speed, and the agitation member 21 vigorously collides with a member, for example, the second frame 18, which causes generation of noise (FIG. 6B). Further, if the agitation member 21 contacts a point H2 (FIGS. 6C and 6D) and a point H3 (FIGS. 6E and 6F), noise is generated by the similar principle.

Figure 5A:
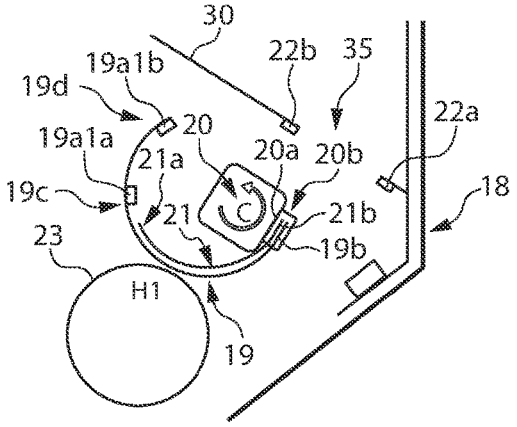
FIGS. 5A, 5B, 5C, 5D, 5E, and 5F are diagrams illustrating developer agitation operation according to an exemplary embodiment of the present invention.
Figure 5B:
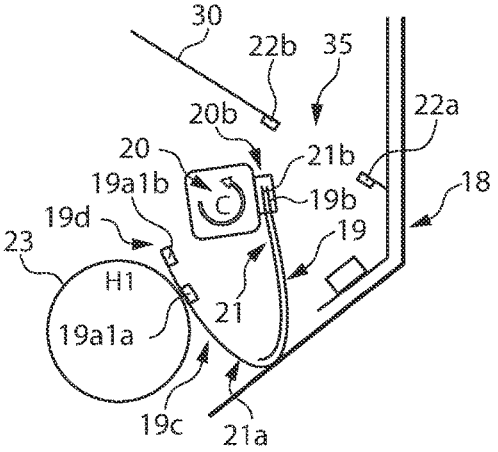
Figure 5C:
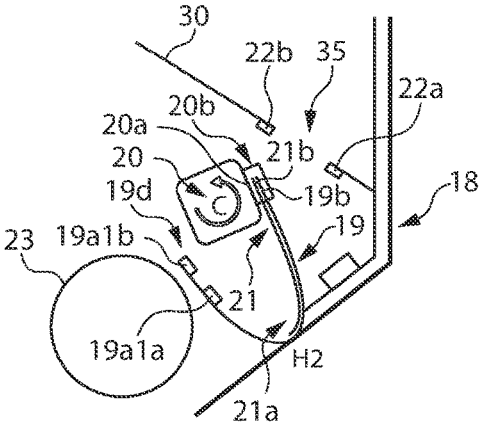
Figure 5D:
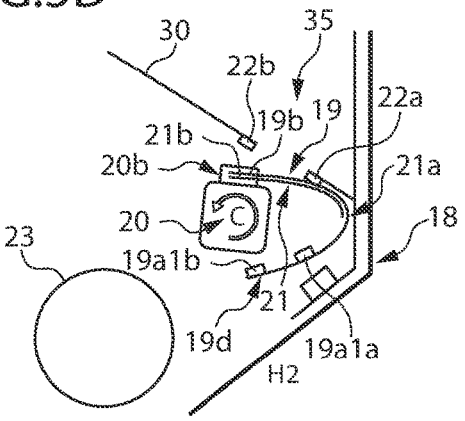
Figure 5E:
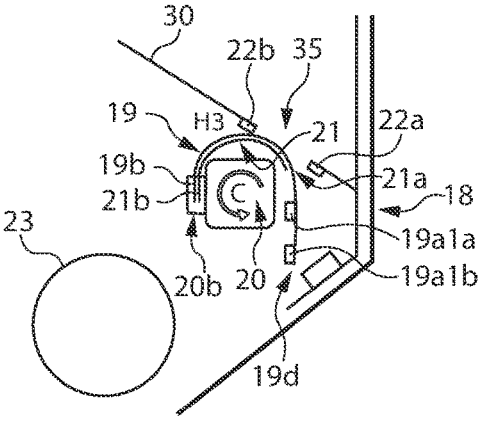
Figure 5F:
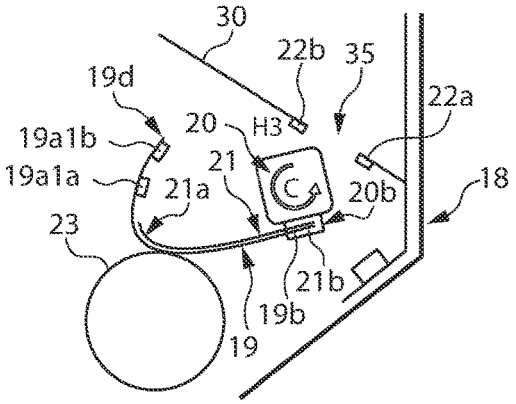

In the present exemplary embodiment, as illustrated in FIGS. 5A through 5F, the free end portion 21*a* is covered with the sealing member 19 during the rotation of the agitation member 21. In FIG. 5A, the sealing member 19 contacts the developer supply roller 23, and the agitation member 21 contacts the developer supply roller 23 via the sealing member 19. That is, the agitation member 21 does not directly contact the developer supply roller 23. The developer supply roller 23 contacts the sealing member 19 at a contact portion of the sealing member 19, and the agitation member 21 contacts a portion (on a downstream side in a rotation direction) opposite the contact portion of the sealing member 19.

With such a positional relation, the sealing member 19 functions as a buffer of when the agitation member 21 collides. Hence, reduction of the impact reduces noise to be generated.

In FIG. 5A, the collision of the sealing member 19 and the agitation member 21 with the developer supply roller 23 is described. However, a similar effect can be achieved even if collision targets are other portions, such as the developing roller 13 and an inner wall of a container for storing developer.

Further, on a rotation direction vertical surface of the unsealing member 20, an area of the sealing member 19 is larger than an area of the agitation member 21. Accordingly, in the rotation of the agitation member 21, the sealing member 19 receives resistance from the developer when pressure of the deformation is released. This suppresses acceleration of the agitation member 21, and the impact at the collision is mitigated, thereby reducing noise to be generated. When the unsealing member 20 is rotated, the sheet member 21 and the sealing member 19 repeatedly contact and separate from an end portion of the opening 35*a*. However, the sheet member 21 does not directly contact a container for storing developer and the sheet member 21 contacts the edge of the opening 35*a* via the sealing member 19.

In the first exemplary embodiment, reduction of noise generated when the sheet member collides with, for example, the developing roller and the developer container. However, the sealing member may also generate collision noise with the developer container depending on rotation speed thereof. In such a case, however, the sheet member can be attached to an attachment portion of the unsealing member in a relative position where the sheet member is held between the unsealing member and the sealing member. Such attachment can reduce the collision noise of the sealing member.

Figure 7:
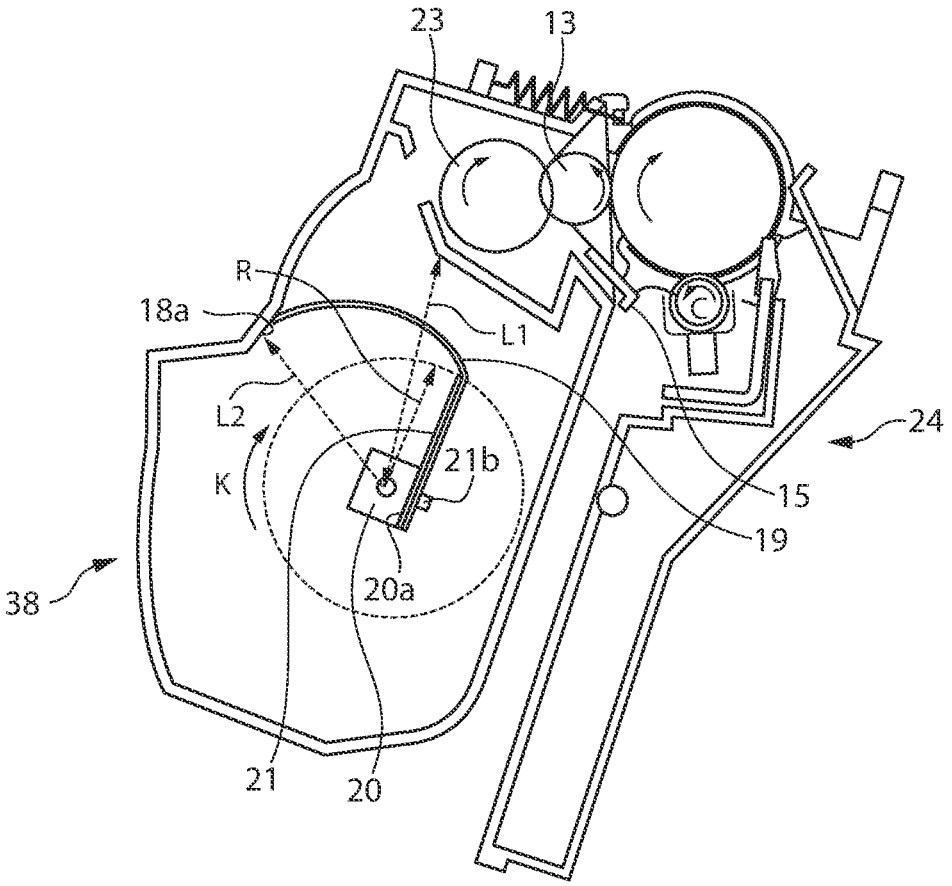
FIG. 7 is a sectional view illustrating a process cartridge according to an exemplary embodiment of the present invention.

FIG. 7 is a sectional view illustrating a process cartridge as seen along an axial direction of a photosensitive drum as an image bearing member. This view is substantially the same as that as seen along a longitudinal direction of the process cartridge.

As illustrated in FIG. 7, the process cartage includes an unsealing member 20, a sealing member 19, and a sheet member 21. Unlike the first exemplary embodiment, a developer bag which is a flexible container in which developer is stored is not included in the process cartridge. In this case, a portion where the sheet member 21 contacts the sealing member 19 is reinforced, so that a portion where the sealing member 19 does not contact the sheet member 21 is bent. Accordingly, a bent region becomes smaller, and reaction of when pressure of the bending is released is reduced. Thus, it is considered that impact noise should be reduced.

As illustrated in FIG. 7, the process cartridge has a distance L1 from a rotation axis of the unsealing member 20 to a side wall including an opening, a distance L2 from the rotation axis of the unsealing member 20 to a deformation portion 18*a* by which the sealing member 19 is elastically deformed, a length R of the sheet member 21, and a rotation trajectory K of a free end of the sheet member 21. In this case, the sheet member 21 is designed so as not to contact other portions of the developer container. That is, the length R is shorter than each of the distances L1 and L2. Such design eliminates generation of noise due to collision of the sheet member 21. On the other hand, although the sealing member 19 is elastically deformed by the deformation portion 18*a*, the sealing member 19 is bent from a portion in which the free end of the sheet member 21 contacts the sealing member 19. Hence, the bent region is smaller. This can reduce energy generated when pressure of the bending is released, so that impact noise due to collision can be reduced.

In the second exemplary embodiment, a toner storage chamber is positioned below a developing chamber including a developing roller. That is, the second exemplary embodiment relates to development in a draw-up configuration. Thus, the opening is positioned above a rotation axis of the unsealing member.

Each of the exemplary embodiments has been described using a configuration in which the process cartridge is detachable from the image forming apparatus. However, the present exemplary embodiment is not limited thereto. For example, a developing device may be independently detachable from the image forming apparatus. In such a case, an image bearing member may be fixed to the image forming apparatus, or the image bearing member may be detachable as an image bearing device from the image forming apparatus. Similarly, a developer container can be independently detachable from the image forming apparatus, or the developer container can be detachable from the developing device.

Moreover, for example, a developer container having shape formed by a combination of the configurations of the first exemplary embodiment and the second exemplary embodiment can be used.

Each of the above configurations can reduce impact noise due to collision of a sheet member or a sealing member with a member such as a container.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-039428, filed Feb. 27, 2015, which is hereby incorporated by reference herein in its entirety.

What is claimed is:

1. A developer container comprising:

a container configured to store developer and capable of discharging the developer from an opening;

a sealing member configured to seal the opening of the container;

an unsealing member, rotatably supported, configured to open the opening by removing the sealing member from the container; and a sheet member attached to an attachment portion of the unsealing member in a position where the sheet member is held between the sealing member and the unsealing member, wherein when one side of the sealing member contacts the container, a free end portion of the sheet member contacts the other side of the sealing member.

2. The developer container according to claim 1, wherein the sealing member is positioned at a downstream side in a rotation direction of the unsealing member with respect to the sheet member.

3. The developer container according to claim 1, wherein the sealing member and the sheet member are stacked and attached to the attachment portion.

4. The developer container according to claim 1, wherein rotation of the unsealing member causes the sealing member to repeatedly contact and separate from an edge portion of the opening.

5. The developer container according to claim 1, wherein a distance from an attachment portion to a free end of the sealing member is longer than a distance from an attachment portion to a free end of the sheet member.

6. The developer container according to claim 1, wherein the sealing member includes a contact portion that contacts a developer bearing member, and wherein, when the sealing member contacts the container, the sheet member contacts a portion opposite the contact portion of the sealing member.

7. The developer container according to claim 1, wherein the opening is positioned above a rotation axis of the unsealing member.

8. The developer container according to claim 1, wherein the unsealing member is arranged inside the container.

9. The developer container according to claim 1, wherein the container is a flexible container.

10. The developer container according to claim 1, wherein the sealing member covers the sheet member.

11. A developing device comprising:

a developer bearing member configured to bear developer; and the developer container according to claim 1.

12. A process cartridge comprising:

an image bearing member; and the developer container according to claim 1.

13. An image forming apparatus comprising the developer container according to claim 1, wherein the image forming apparatus forms an image on a recording medium.

14. A developing device comprising:

a developer bearing member configured to bear developer; and the developer container according to claim 1.

15. A process cartridge comprising:

an image bearing member; and the developer container according to claim 1.

16. An image forming apparatus comprising the developer container according to claim 1, wherein the image forming apparatus forms an image on a recording medium.

17. A developer container comprising:

a container configured to store developer and capable of discharging the developer from an opening;

a sealing member configured to seal the opening;

an unsealing member, rotatably supported, configured to open the opening by removing the sealing member from the container; and a sheet member attached to an attachment portion of the unsealing member in a position where the sheet member is held between the sealing member and the unsealing member, wherein the sealing member and the sheet member are stacked and attached to the attachment portion.

18. The developer container according to claim 17, wherein the sealing member is positioned at a downstream side in a rotation direction of the unsealing member with respect to the sheet member.

19. The developer container according to claim 17, wherein rotation of the unsealing member causes the sealing member to repeatedly contact and separate from an edge portion of the opening.

20. The developer container according to claim 17, wherein a distance from an attachment portion to a free end of the sealing member is longer than a distance from an attachment portion to a free end of the sheet member.

21. The developer container according to claim 17, wherein the sealing member includes a contact portion that contacts a developer bearing member, and wherein, when the sealing member contacts the container, the sheet member contacts a portion opposite the contact portion of the sealing member.

22. The developer container according to claim 17, wherein the opening is positioned above a rotation axis of the unsealing member.

23. The developer container according to claim 17, wherein the unsealing member is arranged inside the container.

24. The developer container according to claim 17, wherein the container is a flexible container.

25. The developer container according to claim 17, wherein the sealing member covers the sheet member.

26. A developing device comprising:

a developer bearing member configured to bear developer; and the developer container according to claim 17.

27. A process cartridge comprising:

an image bearing member; and the developer container according to claim 17.

28. An image forming apparatus comprising the developer container according to claim 17, wherein the image forming apparatus forms an image on a recording medium.

29. The developer container according to claim 17, wherein the sealing member and the sheet member are stacked.

30. A developer apparatus comprising:

a developing roller for developing;

a developer supply roller for supplying developer to the developing roller;

a container configured to store developer;

a sealing member configured to seal an opening of the container;

an unsealing member, rotatably supported, configured to open the opening by removing the sealing member from the container; and a sheet member attached to an attachment portion of the unsealing member in a position where the sheet member is held between the sealing member and the unsealing member, wherein when one surface of the sealing member contacts the developer supply roller, a free end portion of the sheet member contacts the other surface of the sealing member.

31. The developer apparatus according to claim 30, wherein the unsealing member is arranged outside of the container.

32. A developer apparatus comprising:

a developing roller for developing;

a developer supply roller for supplying developer to the developing roller;

a container configured to store developer;

a sealing member configured to seal an opening of the container;

an unsealing member, rotatably supported, configured to open the opening by removing the sealing member from the container; and a sheet member attached to an attachment portion of the unsealing member in a position where the sheet member is held between the sealing member and the unsealing member when the sealing member seals the opening.

33. The developer apparatus according to claim 32, wherein the unsealing member is arranged outside of the container.

* * * * *